US010117554B2

(12) United States Patent
Williamson et al.

(10) Patent No.: US 10,117,554 B2
(45) Date of Patent: Nov. 6, 2018

(54) CLEANER HEAD FOR A VACUUM CLEANER

(71) Applicant: Dyson Technology Limited, Wiltshire (GB)

(72) Inventors: Heidi Williamson, Woking (GB); Stephen Robert Dimbylow, Swindon (GB); Donald James McIntosh, Gloucester (GB); Gerard Matthew Shevlin, Gloucester (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 224 days.

(21) Appl. No.: 14/909,390

(22) PCT Filed: Jul. 24, 2014

(86) PCT No.: PCT/GB2014/052258
§ 371 (c)(1),
(2) Date: Feb. 1, 2016

(87) PCT Pub. No.: WO2015/015166
PCT Pub. Date: Feb. 5, 2015

(65) Prior Publication Data

US 2016/0174792 A1 Jun. 23, 2016

(30) Foreign Application Priority Data

Jul. 31, 2013 (GB) ..... 1313707.0

(51) Int. Cl.
*A47L 9/04* (2006.01)
*A47L 9/06* (2006.01)
(Continued)

(52) U.S. Cl.
CPC ..... *A47L 9/0477* (2013.01); *A46B 9/02* (2013.01); *A46B 13/00* (2013.01); *A47L 9/04* (2013.01); *A47L 9/0422* (2013.01); *A47L 9/068* (2013.01)

(58) Field of Classification Search
CPC ..... A47L 9/0477; A47L 9/04; A47L 9/0422; A47L 9/068; A46B 9/02; A46B 13/00
See application file for complete search history.

(56) References Cited

U.S. PATENT DOCUMENTS 173,582 A * 2/1876 Breckenridge ..... A47L 11/4041 15/48.1
1,393,695 A 10/1921 Paulus
(Continued)

FOREIGN PATENT DOCUMENTS

DE 10 2007 007 844 8/2008
EP 1 116 470 7/2001
(Continued)

OTHER PUBLICATIONS

International Search Report and Written Opinion dated Dec. 23, 2014, directed to International Application No. PCT/GB2014/052258; 13 pages.

*Primary Examiner* — Robert Scruggs
(74) *Attorney, Agent, or Firm* — Morrison & Foerster LLP

(57) ABSTRACT

A cleaner head for a vacuum cleaner including a housing, a roller and a wheel assembly arranged to support the cleaner head on a surface such that the roller is held out of pressing engagement with the surface. The roller is arranged to rotate with respect to the housing and the wheel assembly includes a first wheel which is arranged to drive the roller.

16 Claims, 7 Drawing Sheets

(51) Int. Cl.

| | |
|---|---|
| ***A46B 9/02*** | (2006.01) |
| ***A46B 13/00*** | (2006.01) |

(56) References Cited

U.S. PATENT DOCUMENTS

| | | | |
|---|---|---|---|
| 1,884,013 | A | 10/1932 | Losey |
| 2,022,239 | A | 11/1935 | Harkness |
| 2,682,679 | A | 7/1954 | Ballard |
| 3,108,310 | A | 10/1963 | Allen |
| 8,316,503 | B2 | 11/2012 | Follows et al. |
| 8,782,851 | B2 | 7/2014 | Follows et al. |
| 8,806,710 | B2 | 8/2014 | Follows et al. |
| 2010/0306958 | A1 | 12/2010 | Follows et al. |

FOREIGN PATENT DOCUMENTS

| | | |
|---|---|---|
| FR | 1319994 | 1/1963 |
| GB | 513 | 7/1914 |
| GB | 685208 | 12/1952 |
| GB | 2 386 055 | 9/2003 |
| GB | 2520549 | 5/2015 |
| JP | 47-10677 | 3/1972 |
| JP | 5-317212 | 12/1993 |
| JP | 2000-60777 | 2/2000 |
| JP | 2003-111701 | 4/2003 |
| JP | 2003-250727 | 9/2003 |
| JP | 2004-267723 | 9/2004 |
| JP | 2005-230514 | 9/2005 |
| JP | 2009-11374 | 1/2009 |
| JP | 2009-268684 | 11/2009 |

* cited by examiner

CLEANER HEAD FOR A VACUUM CLEANER

REFERENCE TO RELATED APPLICATIONS

This application is a national stage application under 35 USC 371 of International Application No. PCT/GB2014/052258, filed Jul. 24, 2014, which claims the priority of United Kingdom Application No. 1313707.0, filed Jul. 31, 2013, the entire contents of which are incorporated herein by reference.

FIELD OF THE INVENTION

This invention relates to a cleaner head for a vacuum cleaner, and particularly, although not exclusively, relates to a cleaner head for a hand-held vacuum cleaner.

BACKGROUND OF THE INVENTION

Cleaner heads for vacuum cleaners typically comprise a brush bar located within a housing. A suction opening is provided in a lower surface of the housing, which is commonly known as a sole plate, through which dirt bearing air is drawn into the cleaner head.

A problem associated with conventional cleaner heads is that the close proximity required between the sole plate and the surface being cleaned in order to maintain pick-up performance means that large debris tends to be pushed across the surface being cleaned by the cleaner head rather than being drawn through the suction opening into the cleaner head. Alternatively, the cleaner head may ride up over the debris which can result in a loss of pressure within the cleaner head which adversely affects pick-up performance.

SUMMARY OF THE INVENTION

According to a first aspect of the invention there is provided a cleaner head for a vacuum cleaner, comprising a housing, a roller arranged to rotate with respect to the housing, and a wheel assembly arranged to support the cleaner head on a surface such that the roller is held out of pressing engagement with the surface, wherein the wheel assembly comprises a first wheel which is arranged to drive the roller as the cleaner head is moved across the surface.

The roller may extend in a lateral direction of the cleaner head. The first wheel may be arranged to drive the roller as the cleaner head is moved forward and backward across the surface on which the cleaner head is supported. For example, the first wheel may be arranged to drive the roller in opposite directions as the cleaner head is moved back and forth across the surface on which the cleaner head is supported. The roller may be arranged to rotate freely with respect to the housing such that the roller is driven solely by movement of the cleaner head across the surface on which the cleaner head is supported.

The roller may be fixed for rotation with the first wheel such that the roller rotates in the same direction as the first wheel. The rotational axis of the first wheel may be coaxial with the rotational axis of the roller. The first wheel may be formed integrally with the roller. The maximum diameter of the roller may be not greater than the maximum diameter of the first wheel.

An agitator may be disposed within the housing. The agitator may, for example, comprise a brush bar. The roller may be disposed rearwardly of the agitator.

The wheel assembly may comprise a second wheel spaced from the first wheel in a direction which is parallel with the rotational axis of the roller. The second wheel may be arranged to rotate with respect to the roller. The rotational axis of the second wheel may be coaxial with the rotational axis of the roller. The wheels may be disposed at opposite ends of the roller. The second wheel may be disposed between an end of the roller and the housing.

The roller may comprise a rigid tubular portion. The wheel assembly may support the cleaner head such that an outer radial surface of the rigid tubular portion is spaced away from the surface on which the cleaner head is supported. In particular, the wheel assembly may be arranged such that when the cleaner head is supported on a flat surface, the rigid tubular portion is spaced away from said flat surface.

The roller may comprise a deformable material which covers substantially all of the radially outer surface of the rigid tubular portion. For example, at least 80% and preferably at least 90% of the surface area of the radially outer surface may be covered by the deformable material. The deformable material may be a resiliently deformable material.

The deformable material may be arranged such that, in use, the deformable material seals against the surface on which the cleaner head is supported. The roller may extend along a trailing edge of the housing.

The housing may have a trailing edge which, in use, seals against the surface on which the cleaner head is supported and the roller is disposed rearwardly of the trailing edge of the housing.

According to a second aspect of the invention there is provided a vacuum cleaner comprising a cleaner head in accordance with the first aspect of the invention.

BRIEF DESCRIPTION OF THE DRAWINGS

In order to better understand the present invention, and to show more clearly how the invention may be put into effect, the invention will now be described, by way of example, with reference to the following drawings.

DETAILED DESCRIPTION OF THE INVENTION

Figure 1:
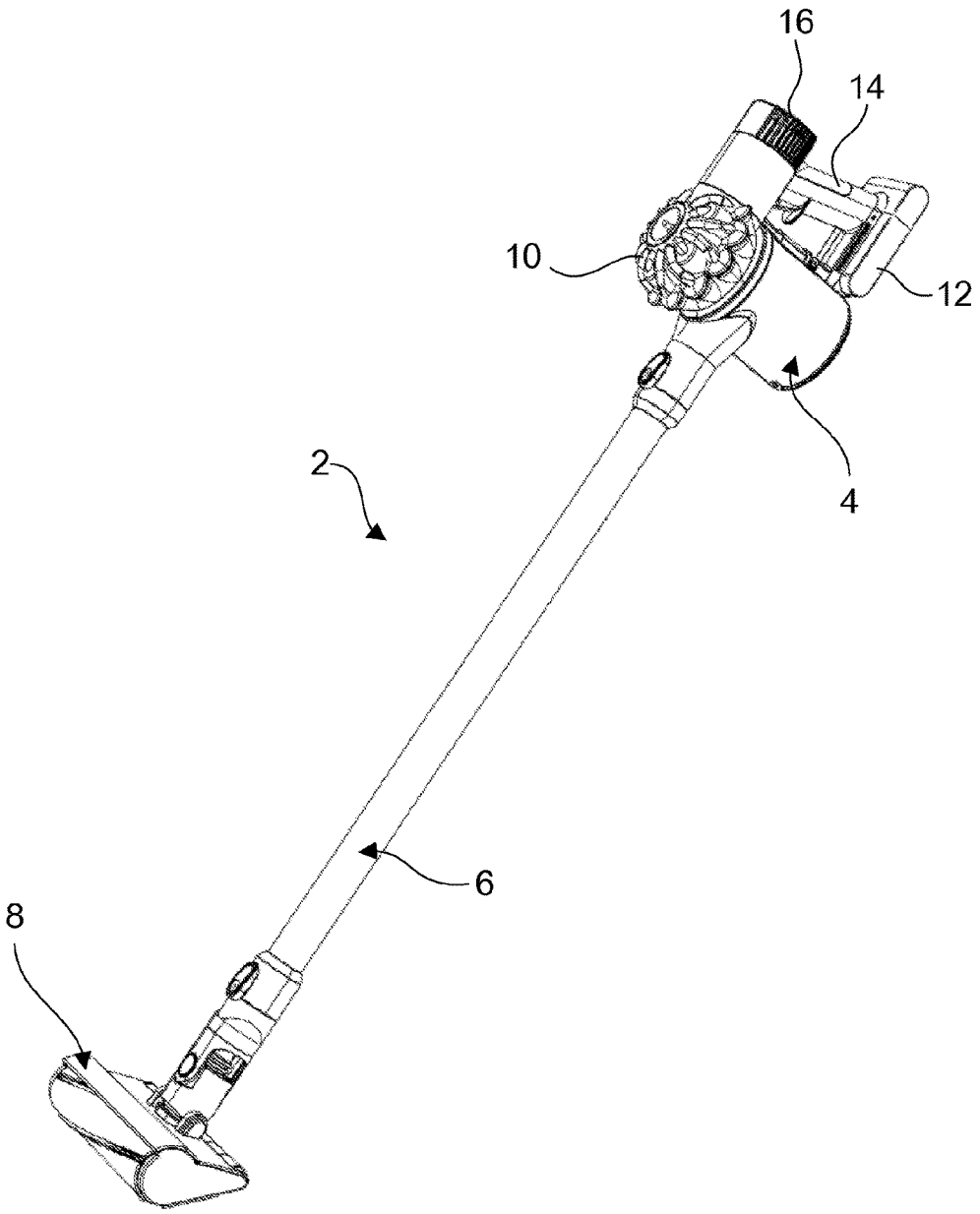
FIG. 1 is a perspective view of a hand-held vacuum cleaner.
Figure 2:
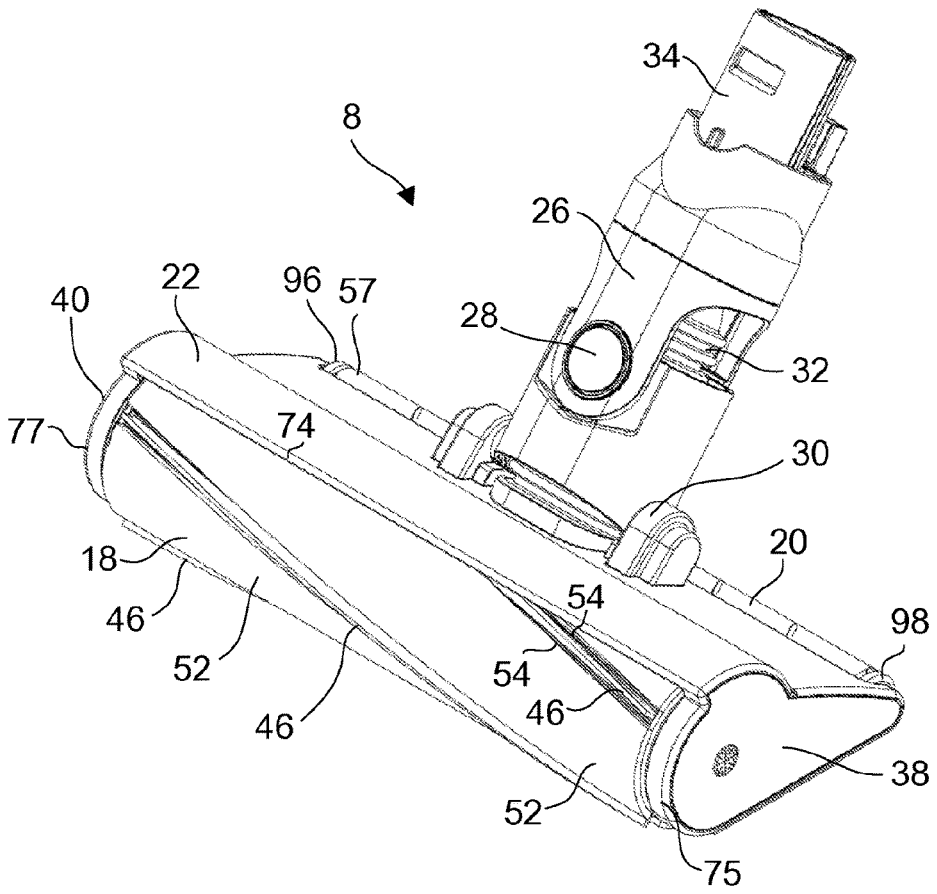
FIG. 2 is a perspective view of the cleaner head of the vacuum cleaner shown in FIG. 1.
Figure 3:
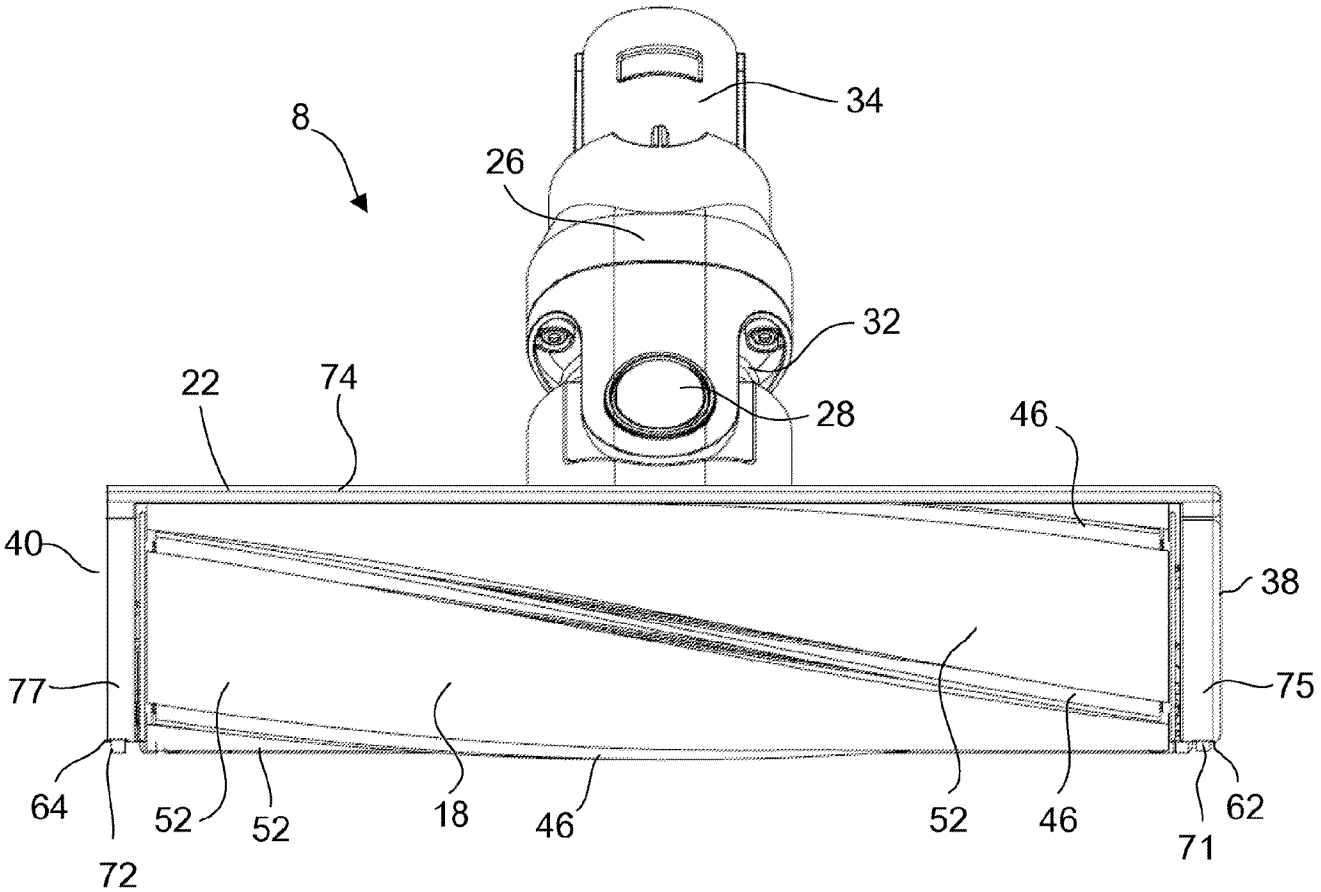
FIG. 3 is a front view of the cleaner head shown in FIG. 2.
Figure 4:
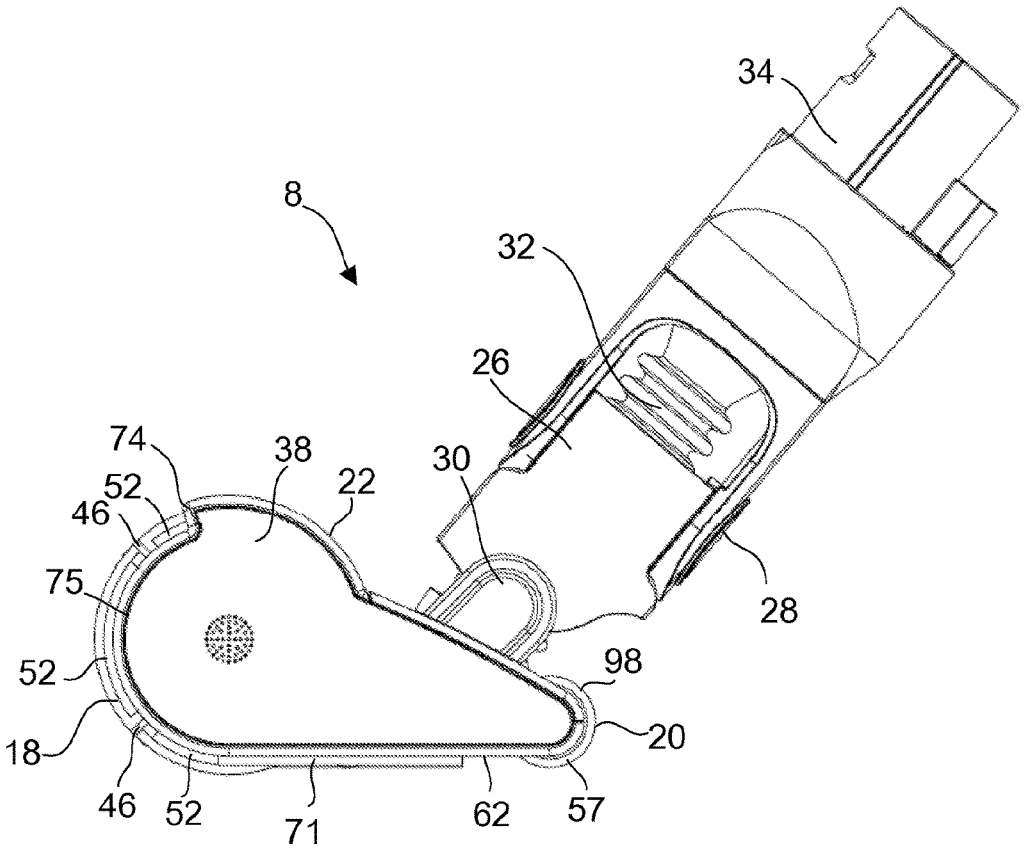
FIG. 4 is a side view of the cleaner head shown in FIG. 2.
Figure 5:
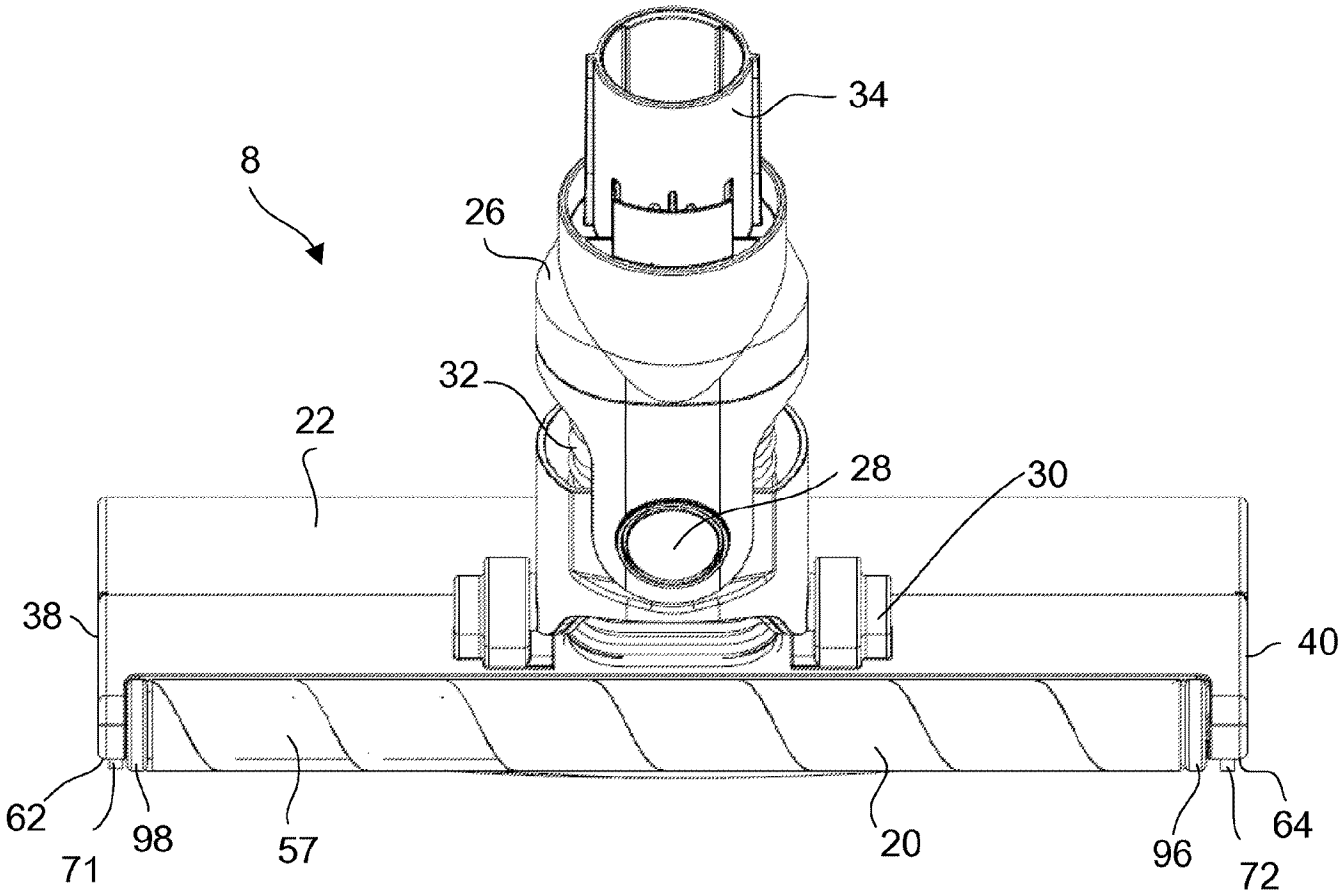
FIG. 5 is a rear view of the cleaner head shown in FIG. 2.
Figure 6:
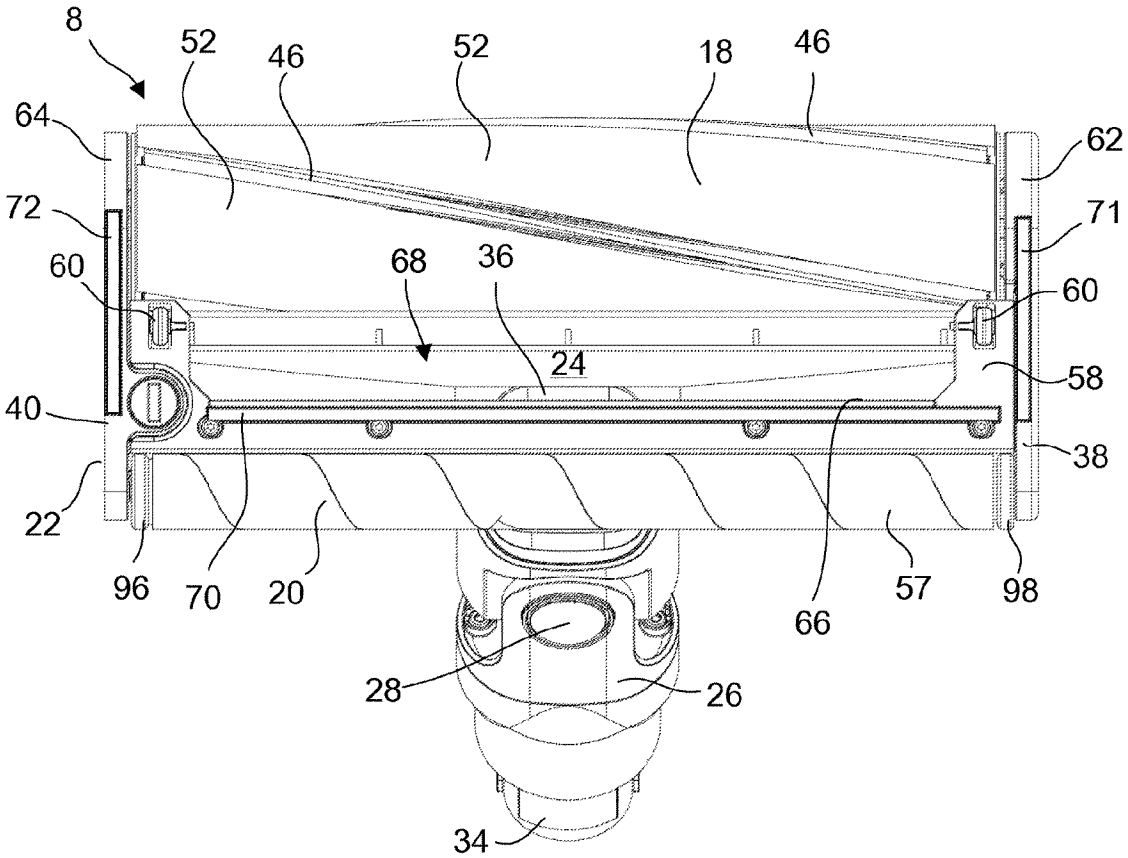
FIG. 6 is an underside view of the cleaner head shown in FIG. 2.

FIG. 1 shows a hand-held vacuum cleaner 2 comprising a main body 4, a wand 6 and a cleaner head 8.

The main body 4 comprises a separating system 10, in the form of a cyclonic separator, a motor and impeller (not visible) arranged to draw air through the separating system 10, and a power supply 12, in the form of a battery, for powering the motor. The main body 4 has a handle 14 which is gripped by a user, and a clean air outlet 16 through which air that has passed through the separating system 10 is discharged.

The wand 6 is attached at one end to the main body 4 and at the other end to the cleaner head 8. The wand 6 provides fluid communication between the cleaner head 8 and the separating system 10, and supports the cleaner head 8 during use.

FIGS. 2 to 7 show the cleaner head 8 in isolation. The cleaner head 8 comprises an agitator in the form of a brush bar 18, a rear roller 20, and a housing 22 which defines a chamber 24 within which the brush bar 18 and the rear roller 20 are at least partially disposed.

The housing 22 is connected to the wand 6 by a pivoting arrangement 26 comprising upper and lower pivotal joints 28, 30 which enable the cleaner head 8 to be pivoted in yaw and pitch with respect to the wand 6. A flexible hose 32 extends from a connecting portion 34 of the pivoting arrangement 26 into an upper region of the chamber 24. The end of the hose 32 that extends into the chamber 24 defines a dirty air outlet 36 (shown in FIGS. 6 and 7) from the chamber 24 through which air is drawn into the wand 6 and through the separating system 10.

The brush bar 18 and the rear roller 20 are supported at each of their respective ends by side walls 38, 40 of the housing 22. The brush bar 18 and the rear roller 20 are each rotatably supported by the side walls 38, 40 so that they can rotate with respect to the housing 22.

Figure 7:
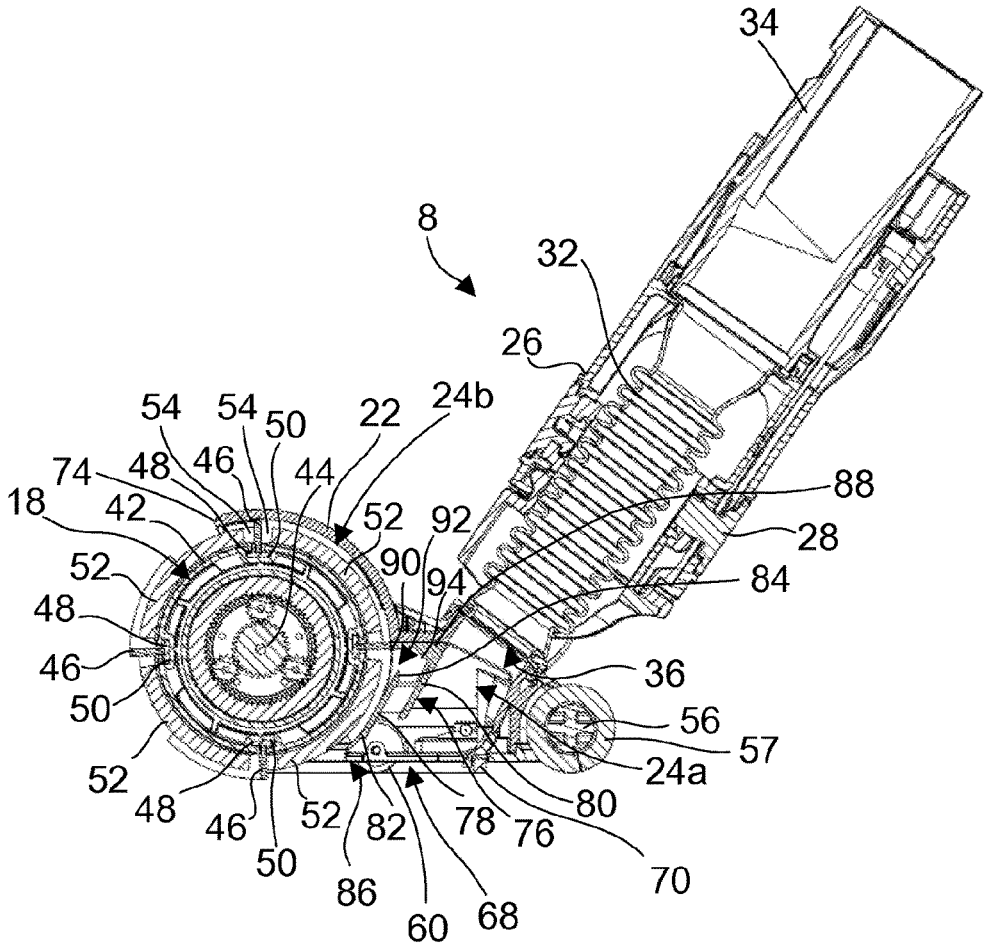
FIG. 7 is a sectional view in the transverse direction of the cleaner head shown in FIG. 2.

With reference to FIG. 7, the brush bar 18 comprises a core 42 in the form of a rigid tube within which a brush bar motor (not shown) and a transmission 44 are disposed. The motor and the transmission 44 are arranged to drive the brush bar 18. The brush bar 18 comprises four bristle strips 46, also known as "starts", spaced circumferentially about the core 42. The bristle strips 46 are spaced apart from each other by the same separation angle (i.e. 90 degrees). Each bristle strip 46 comprises a row of radially extending bristles which are held by a locating strip 48. The bristles may be densely packed, or spaced apart either in clumps or individually.

Each bristle strip 46 extends both longitudinally and circumferentially with respect to the brush bar 18 in a generally helical configuration. Each bristle strip 46 extends circumferentially through an angle of 90 degrees over the length of the brush bar 18. The locating strip 48 of each bristle strip 46 is secured to the core 42 within a corresponding groove 50 provided in the outer surface of the core 42. Each groove 50 has opposing lips along each edge of the groove 50 which interlock with the locating strip 48 to secure the bristle strip 46 to the core 42.

Strips of a sealing material 52 are secured to the outer surface of the core 42 between the bristle strips 46. The sealing material is locally deformable so that debris pressed into the material is at least partially enveloped by the material. The sealing material may also be resilient so that once debris has been extracted, the material returns to a nominal shape. However, it will be appreciated that centrifugal forces acting on the brush bar 18 during use may return the sealing material to its nominal shape.

In the embodiment shown, the sealing material is a tufted material. The material may, for example, be a tufted material having a short dense pile and may be formed by filaments woven to a fabric substrate. The filaments of the pile may be made from nylon, or other suitable material having a relatively low stiffness. The stiffness of a tufted sealing material will depend on the elastic properties of the material, the filament diameter, filament length and pile density. In the embodiment shown, the tufted material is made from nylon and has a filament diameter of between 30 μm and 50 μm (preferably 30 μm), a filament length of 0.005 m and a pile density of 60,000 filaments/25 mm2. The sealing material need not be a tufted material, but could be a foam material such as a closed cell foam material or other suitable material that provides adequate flow restriction. It will be appreciated that although a deformable sealing material is preferred, this is not essential.

There are four strips of sealing material 52 in total. The thickness (i.e. radial depth) of each strip of sealing material 52 is substantially constant, and the sealing strips 52 are substantially identical.

Each strip of sealing material 52 extends over substantially the entire radial and axial extent of the outer surface of the rigid tube 42 between adjacent bristle strips 46. For example, each strip of sealing material 52 may extend over an angle of 75 to 90 degrees, preferably 80 to 90 degrees of the circumferential extent of the brush bar 18. A gap 54 may be formed between one or more of the bristle strips 46 and an adjacent strip of sealing material 52. In the embodiment shown, each strip of sealing material 52 extends over an angle of 80 degrees and each a gap 54 extending through an angle of 5 degrees is formed each side of each bristle strip 46 (reference signs are provided for the gaps 54 on opposite sides of only one of the bristle strips 46). The gaps 54 allow the bristle strips 46 to flex slightly without contacting the strips of sealing material 52. It will be appreciated that the strips of sealing material 52 may abut the bristle strips 46 so that no gaps are provided between the strips of sealing material 52 and the bristles. This is expected to improve sealing effectiveness.

Fewer or more bristle strips 46 may be provided, in which case a corresponding number of strips of sealing material 52 are used. For example, two or three bristle strips 46 may be provided.

The radial extent of the bristle strips 46 is greater than the radial extent of the strips of sealing material 52. That is, the radial distance between the tips of the bristle strips 46 and the rotational axis of the brush bar 18 is greater than the radial distance between the periphery of the strips of sealing material 52 and the rotational axis of the brush bar 18. The radius of the brush bar 18 is defined as the distance between the axis of the brush bar 18 and the tips of the bristle strips 46.

The bristles of the bristle strips 46 are preferably made from a material which is stiffer than the sealing material disposed between the bristle strips 38. The bristle strips may comprise carbon fibre filaments having a thickness of between 5 μm and 10 μm, preferably 7 μm.

The rear roller 20 comprises a core 56 in the form of a solid shaft wrapped in a strip of a tufted material 57. The tufted material 57 may be the same as the tufted material of the brush bar 18. First and second wheels 96, 98 are disposed at opposite ends of the roller 20. The first wheel 96 comprises a circular disc that is secured to the end of the roller 20, for example by welding or gluing or by being formed integrally with the roller 20, such that it is fixed for rotation with the roller 20. The first wheel 96 is therefore fixed for rotation with the roller 20. The second wheel 98 also comprises a circular disc which is similar to the first wheel 96. The second wheel 98 is disposed between an end of the roller 20 and the side wall 38 of the housing 22. The second wheel 98 is mounted to a bearing assembly (not shown) so that it can rotate freely with respect to the housing 22 and the roller 20.

The diameters of the wheels 96, 98 are greater than the maximum diameter of the core 56. The length of the pile of the tufted material 57 is uniform about the circumference and length of the roller 20. The pile is upstanding, but does not extend further radially outwardly than the outer edge of the wheels 96, 98 and so does not impede the drive provided by the first wheel 96. Preferably, the maximum diameter of the roller 20 including the pile is not greater than the diameters of the first and second wheels 96, 98. However, it will be appreciated that a sufficiently compliant the pile could be arranged to interfere with the surface in order to seal against the surface provided that it does not impede the drive by the first wheel 96.

Both wheels 96, 98 are constructed from a rigid material, for example a rigid plastic. The radially outer surface of at least the first wheel 96 of the wheels 96, 98 should comprise a material that provides good traction when rolled along a surface.

Even though the tufted material 57 may contact the surface on which the cleaner head is supported, neither the tufted material 57 nor the core 56 supports the cleaner head 8 on the surface. Consequently, the roller 20 is not in pressing engagement with the surface on which the cleaner head 8 is supported.

The underside of the housing 22 is open. In the embodiment shown, the housing 22 comprises a rear sole plate 58 (see FIG. 6) which extends transversely with respect to the cleaner head 8 from one of the side walls 38, 40 of the housing 22 to the other. A support in the form of wheels 60 are supported by the sole plate 58. The wheels 60 are set into the sole plate 58 so that only a lower portion of each wheel 60 protrudes from the sole plate 58.

Each side wall 38, 40 has a lower edge 62, 64. The sole plate 28 has a leading edge 66, which is a working edge, that extends from one of the lower edges 62, 64 to the other. The lower edges 62, 64 of the side walls 38, 40 and the leading edge 66 of the sole plate 58 together define the side and rear peripheral edge of a dirty air inlet 68 of the chamber 24.

The forward peripheral edge of the dirty air inlet 68 is defined by the brush bar 18. In particular, the forward periphery of the dirty air inlet 68 is defined by the lowermost radial periphery of the strips of sealing material 52.

The wheels 60 support the cleaner head 8 on a surface being cleaned such that the sole plate 58, the side walls 38, 40 and the strips of sealing material 52 are spaced from the surface. In the embodiment shown, the brush bar 18 is arranged such that strips of sealing material 52 are spaced from the surface being cleaned by an amount that provides clearance of the strips of sealing material 52 from the surface, but which does not impair the sealing effectiveness between the strips of sealing material 52 and the surface.

The sole plate 58 and the side walls 38, 40 are spaced further from the surface being cleaned than the strips of sealing material 52. A rear sealing strip 70 is therefore provided along the underside of the sole plate 58 adjacent the leading edge 66. Side sealing strips 71, 72 are also provided along the lower edges 62, 64 of the side walls 38, 40. The sealing strips 70, 71, 72 are arranged to seal against the surface being cleaned during use. The sealing strips 70, 71, 72 comprise a material having a pile, for example a tufted fabric/brush-like fabric having filaments made of a suitable material, such as nylon.

The housing 22 has an upper front edge 74 which extends transversely with respect to the cleaner head 8. The upper front edge 74 is above the rotational axis of the brush bar 18 and below the top of the brush bar 18. The brush bar 18 extends forwards of the upper front edge 74. The upper front edge 74 and the front edges 75, 77 (shown in FIGS. 3 and 4) of the side walls 38, 40 define a front opening of the chamber 24.

The inner surface of a front region of the housing 22 which defines part of the chamber 24 curves over the top of the brush bar 18. The radius of curvature of the inner surface of the chamber 24 corresponds to the radius of the tips of the bristle strips 46. The front region of the housing 22 adjacent the front edge 74 provides a guard which prevents debris from being flung upwardly and/or forwardly by the brush bar 18 during use. However, it will be appreciated that in alternative embodiments the housing need not be arranged as a guard and need not extend forwardly of the top of the brush bar 18. It will be appreciated that a small clearance may be provided to prevent interference between the tips of the bristles and the housing 22. The brush bar 18 is arranged so that the sealing material restricts flow between the brush bar 18 and the inner surface of the housing adjacent the front edge 74.

A partition 76 is arranged within the chamber 24 between the brush bar 18 and the chamber outlet 36. The partition 76 extends transversely with respect to the cleaner head 8 and divides the chamber 24 into a settling region 24*a*, between the partition 76 and the chamber outlet 36, and an agitating region 24*b*, forward of the partition 76.

The partition 76 comprises a front wall 78 and a rear wall 80 which extend across the chamber 24. The front wall 78 is supported at each end by the side walls 38, 40 of the housing 22. The front wall 78 extends in a plane which is substantially tangential to the brush bar 18, and inclined rearwardly with respect to the upright direction of the cleaner head 8. The front wall 78 has a lower edge 82 and an upper edge 84 which extend along the length of the front wall 78. The lower edge 82 and the sidewalls 38, 40 define a first debris opening 86 beneath the front wall 78 in the form of a slot. The first debris opening 86 extends in a direction which is parallel with the rotational axis of the brush bar 18.

The rear wall 80 is disposed between the front wall 78 and the chamber outlet 36, and extends downwardly from an upper region of the chamber 24 in a direction which is substantially parallel with the front wall 78.

The rear wall 80 has a joining portion 88 which abuts the housing 22. The joining portion 88 has a front edge 90. The upper edge 84 of the front wall 78 and the front edge 90 of the joining portion 88 define a second debris opening 92 in the form of a slot. The second debris opening 92 extends in a direction which is parallel with the rotational axis of the brush bar 18. The front edge 90 is substantially level with the rotational axis of the brush bar 18 and forms a lip that overhangs the upper edge 84 of the front wall 78 (i.e. the front edge 90 projects radially inwardly of the upper edge 84 with respect to the rotational axis of the brush bar 18).

The front wall 78 and the rear wall 80 define a debris recovery passageway which extends downwardly and forwardly from the second debris opening 92. The passageway opens at the lower end into the settling region 24*a* of the chamber 24. A portion of the joining portion 88 between the rear wall 80 and the front edge 90 has an inclined front surface 94 which is inclined forwardly at an angle of between 35 degrees and 65 degrees to the upright direction of cleaner head 8. The inclined front surface 94 forms a deflector for deflecting debris downwardly along the passageway defined by the front and rear walls 78, 80.

In use, the cleaner head 8 of the vacuum cleaner 2 is placed on a floor, for example a floor having a hard surface. The cleaner head 8 is supported on the surface by the rollers 60 so that the sealing strips 70, 71, 72, together with the lower periphery of the sealing material of the brush bar 18, seal against the surface being cleaned. The chamber 24 is therefore sealed around the periphery of the dirty air inlet 68 by the sealing strips 70, 71, 72 and the sealing material 52 of the brush bar 18. In addition, the brush bar 18 seals against the upper inner surface of the housing 22 adjacent the front edge 74.

In the context of the specification, the term "seal" should be understood to mean capable of maintaining a predetermined pressure difference during use of the vacuum cleaner 2. For example, the chamber 24 can be regarded as being sealed provided that the flow of air through the chamber 24 is restricted to an amount that is sufficient to maintain a pressure difference of at least 0.65 kPa between the inside of chamber 24 and ambient during normal use (e.g. when used to clean a hard/firm surface). Similarly, the brush bar 18 can be considered to be sealed against the housing 22 if the flow of air through the front opening is restricted by the brush bar 18 such that a pressure difference of at least 0.65 kPa between the inside of chamber 24 and ambient is maintained during normal use.

The motor and the impeller draw air into the chamber 24 through the dirty air inlet 68 in the housing 22 and upwardly through the chamber outlet 36, through the wand 6 and into the separating system 10. Dirt is extracted from the air by the separating system 10 before being exhausted through the clean air outlet 16.

The brush bar 18 is driven in a forward direction which is the counter-clockwise direction in FIG. 7. The brush bar 18 is driven at a relatively high rotational speed, for example between 600 rpm and 3000 rpm, preferably between 600 rpm and 1400 rpm. Increasing the rotational speed can be expected to improve fine dust pick up performance. The boundary layer effect in the vicinity of the sealing material 52 and the bristle strips 46 causes rotational flow within the agitating region 24*b* of the chamber 24 in the direction of rotation of the brush bar 18. The rotational flow dynamically seals the gap between the brush bar 18 and the front edge 74 of the housing 22. This dynamic sealing of the chamber 24 helps to maintain pressure within the chamber 24 by further restricting flow of air between the brush bar 18 and the housing 22.

As the cleaner head 8 is moved across the surface being cleaned, the tips of the bristles of the bristle strips 46 contact the surface and sweep debris rearwardly towards the first debris opening 86. The bristles are particularly effective at removing fine dust from crevices and agitating dust that has been compacted on the surface being cleaned. The gaps 54 extending along each side of the bristle strips 46 accommodate flexing of the bristles as they are pressed against the surface of the floor.

As the cleaner head 8 is moved over large debris (i.e. debris that is larger than the clearance between the periphery of the sealing material 52 and the floor), for example grains of rice, oats, pasta, cereals or similar, the sealing material 52 is deformed locally by the debris.

Local deformation of the sealing material 52 ensures that, for most large debris, the cleaner head 8 does not ride-up over the debris, which would reduce sealing effectiveness between the sealing strip 70, 71, 72, the sealing material 52 on the brush bar 18 and the floor surface. Sealing between the brush bar 18 and the surface being cleaned is therefore not adversely affected, and so effective pick-up performance is maintained. The large debris, which has been substantially enveloped by the sealing material 52, is then released rearwardly through the first debris opening 86 into the settling region 24*a* of the chamber 24. Smaller debris or debris which clings to the floor, such as compacted dust, is agitated by the bristle strips 46 and swept rearwardly through the first debris opening 86 into the settling region 24*a* of the chamber 24. The debris, as well as other debris which may have been drawn directly up through the dirty air inlet 68, is sucked through the chamber outlet 36 to the separating system 10, as described above.

It will be appreciated that the sealing material 52 also deforms to accommodate small variations in the surface being cleaned without causing scratching of the surface.

In some circumstances, debris having relatively high inertia such as large debris, for example rice or large dust particles, rebounds off the rear wall of the settling region 24*a* of the chamber 24 back though the first debris opening 86 without being sucked up through the chamber outlet 36. Such debris collides with the brush bar 18 and is swept either back through the first debris opening 86 or else is driven upwardly along the front surface of the front wall 78 of the partition 76 towards the second debris opening 92. The overhanging front edge 90 intercepts the debris and directs the debris rearwardly towards the inclined front surface 94 of the joining portion 88. The overhanging front edge 90 therefore prevents the debris from being swept along the inner surface of the chamber 24 and out through the front opening by the brush bar 18.

Debris which collides with the inclined front surface 94 is directed downwardly along the passageway between the front and rear walls 78, 80 of the partition 76 into the settling region 24*a* of the chamber 24. Each collision of the debris with the front and rear walls 78, 80 dissipates some of the kinetic energy of the debris, thereby reducing its inertia. Consequently, debris that falls down along the passageway into the settling region 24*a* is entrained by the air flowing through the chamber 24 and sucked the chamber outlet 36 to the separating system 10.

The front opening of the housing 22 allows the brush bar 18 to be pushed up against an object on the surface being cleaned or against a wall so the brush bar can pick up debris adjacent the object or wall. This improves overall pick up performance.

The rear roller 20 is arranged to roll over debris on the surface being cleaned. Therefore, debris is not scraped along the surface being cleaned which could otherwise scratch the surface. The roller 20 also reduces the likelihood of the cleaner head 8 riding up over large debris as it moves over the surface being cleaned, which would otherwise result in a temporary loss of pressure within the cleaner head 8 and a reduction in pick-up.

The roller 20 is driven directly by the first wheel 96 and so rotates in the same direction as the first wheel 96. For example, if the first wheel 96 rotates in a clockwise direction (as viewed in FIG. 4) on a backward stroke of the cleaner head 8, the roller 20 will also rotate in a clockwise direction (and vice versa). Because the diameter of the first wheel 20 is greater than the core 56, the tufted material 57 only touches the floor lightly. Therefore, the roller 20 is not in pressing engagement with the floor and the roller 20 does not provide any substantial support for the cleaner head 8. The roller 20 is therefore driven primarily by the first wheel 96 and not by contact between the roller 20 and the floor. Consequently, even if large debris becomes trapped under the roller 20, the roller 20 will not stall. Instead, the first wheel 96 continues to drive the roller 20 which will sweep the debris underneath the roller 20. The tufted material 57 will also maintain a seal against the floor.

Furthermore, as the cleaner head 8 is steered across the floor, the first and second wheels 96, 98 rotate independently of each other (e.g. the first wheel 96 rotates at a rate which is greater or less than the rate of rotation of the second wheel 98 depending on the direction of the turn) and so neither of the wheels 96, 98 skid. This makes it easier to manoeuvre the cleaner head 8 across the surface.

The cleaner head 8 is effective at picking up both small and large debris as well as dust that has been compacted. The cleaner head 8 is particularly effective on hard floors in which large debris stands proud of the surface, or on which dust has been compacted.

The invention claimed is:

1. A cleaner head for a vacuum cleaner, comprising:

a housing;

a roller arranged to rotate with respect to the housing about a rotational axis; and a wheel assembly arranged to support the cleaner head on a surface such that the roller is held out of pressing engagement with the surface, wherein the wheel assembly comprises:

a first wheel which is arranged to drive the roller as the cleaner head is moved across the surface, wherein a rotational axis of the first wheel is coaxial with the rotational axis of the roller, and a second wheel spaced from the first wheel in a direction which is parallel with the rotational axis of the roller, wherein the second wheel is free to rotate relative to the roller and the housing.

2. The cleaner head of claim 1, wherein the roller extends in a lateral direction of the cleaner head and the first wheel is arranged to drive the roller as the cleaner head is moved forward and backward across the surface on which the cleaner head is supported.

3. The cleaner head of claim 1, wherein the roller is fixed for rotation with the first wheel such that the roller rotates in the same direction as the first wheel.

4. The cleaner head of claim 1, wherein the first wheel is formed integrally with the roller.

5. The cleaner head of claim 1, wherein the maximum diameter of the roller is not greater than the maximum diameter of the first wheel.

6. The cleaner head of claim 1, wherein an agitator is disposed within the housing.

7. The cleaner head of claim 1, wherein the rotational axis of the second wheel is coaxial with the rotational axis of the roller.

8. The cleaner head of claim 1, wherein the wheels are disposed at opposite ends of the roller.

9. The cleaner head of claim 1, wherein the second wheel is disposed between an end of the roller and the housing.

10. The cleaner head of claim 1, wherein the roller comprises a rigid tubular portion and the wheel assembly supports the cleaner head such that an outer radial surface of the rigid tubular portion is spaced away from the surface on which the cleaner head is supported.

11. The cleaner head of claim 10, wherein the roller comprises a deformable material which covers substantially all of the radially outer surface of the rigid tubular portion.

12. The cleaner head of claim 11, wherein the deformable material is a resiliently deformable material.

13. The cleaner head of claim 11, wherein roller is arranged such that, in use, the deformable material seals against the surface on which the cleaner head is supported.

14. The cleaner head of claim 1, wherein the roller extends along a trailing edge of the housing.

15. The cleaner head of claim 14, wherein the housing has a trailing edge which, in use, seals against the surface on which the cleaner head is supported and the roller is disposed rearwardly of the trailing edge of the housing.

16. A vacuum cleaner comprising the cleaner head of claim 1.

* * * * *